US007490606B2

(12) United States Patent
Duke

(10) Patent No.: US 7,490,606 B2
(45) Date of Patent: Feb. 17, 2009

(54) MEDICAL GARMENT VENTILATION SYSTEM

(76) Inventor: Derek A. Duke, 2057 Jupiter Hills La., Henderson, NV (US) 89012

( * ) Notice: Subject to any disclaimer, the term of this patent is extended or adjusted under 35 U.S.C. 154(b) by 702 days.

(21) Appl. No.: 11/237,207

(22) Filed: Sep. 28, 2005

(65) Prior Publication Data

US 2007/0079829 A1 Apr. 12, 2007

(51) Int. Cl.
*A61M 11/00* (2006.01)

(52) U.S. Cl. ..... 128/201.29; 128/201.15; 2/DIG. 1; 2/901

(58) Field of Classification Search ..... 128/201.29, 128/201.15, 202.12; 2/102, DIG. 1, 901
See application file for complete search history.

(56) References Cited

U.S. PATENT DOCUMENTS

| | | | | |
|---|---|---|---|---|
| 2,144,611 | A | 1/1939 | Biggs | |
| 3,049,896 | A | 8/1962 | Webb | |
| 3,625,206 | A | 12/1971 | Charnley | |
| 4,055,173 | A * | 10/1977 | Knab | 128/847 |
| 4,146,933 | A | 4/1979 | Jenkins et al. | |
| 4,741,333 | A * | 5/1988 | Suzuki et al. | 128/201.23 |
| 5,009,225 | A * | 4/1991 | Vrabel | 128/201.24 |
| 5,014,355 | A * | 5/1991 | Vollenweider, II | 2/79 |
| 5,421,326 | A | 6/1995 | Rankin et al. | |
| 5,492,108 | A * | 2/1996 | Smith et al. | 128/201.15 |
| 5,588,153 | A | 12/1996 | Ignon et al. | |
| 5,682,618 | A | 11/1997 | Johnson et al. | |
| 5,970,519 | A * | 10/1999 | Weber | 2/81 |
| 6,349,412 | B1 * | 2/2002 | Dean | 2/102 |
| 6,718,785 | B2 | 4/2004 | Bieberich | |

* cited by examiner

*Primary Examiner*—Steven O Douglas
(74) *Attorney, Agent, or Firm*—Weide & Miller, Ltd.

(57) ABSTRACT

A medical garment ventilation system comprises a generally planar intake body having an intake face defining a plurality of intake ports spaced over the intake face, the intake body defining at least one outlet, the at least one outlet and one or more of the plurality of intake ports connected to one another by one or more passages through the body, at least one generally closed air flow path, the path having a first end in communication with at least one of the outlets of the intake body, and an air suction device for drawing air through the intake ports, through the intake body to the at least one closed air flow path, and along the at least one airflow path to an exhaust.

18 Claims, 3 Drawing Sheets

Fig. 1
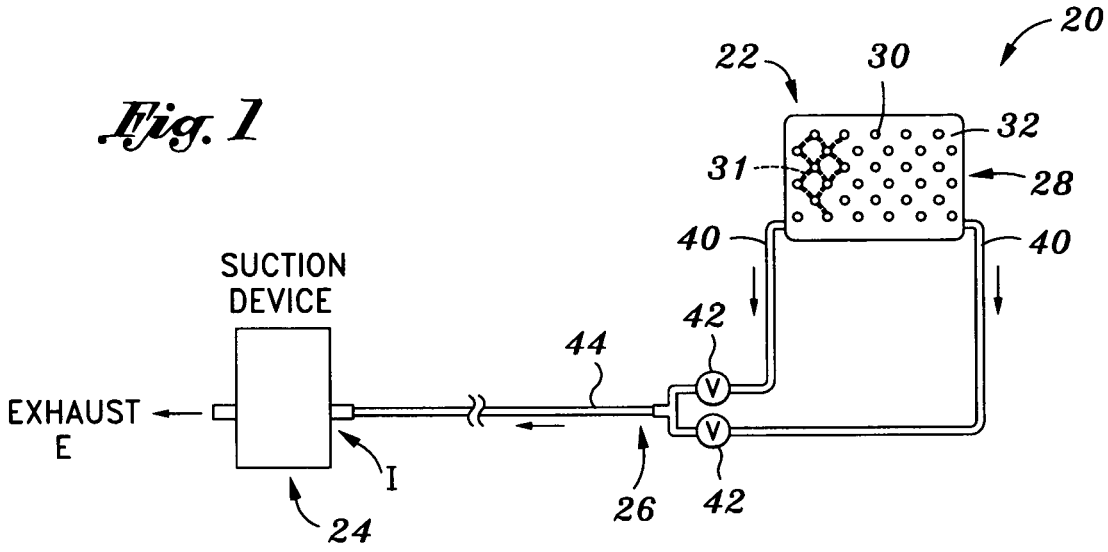
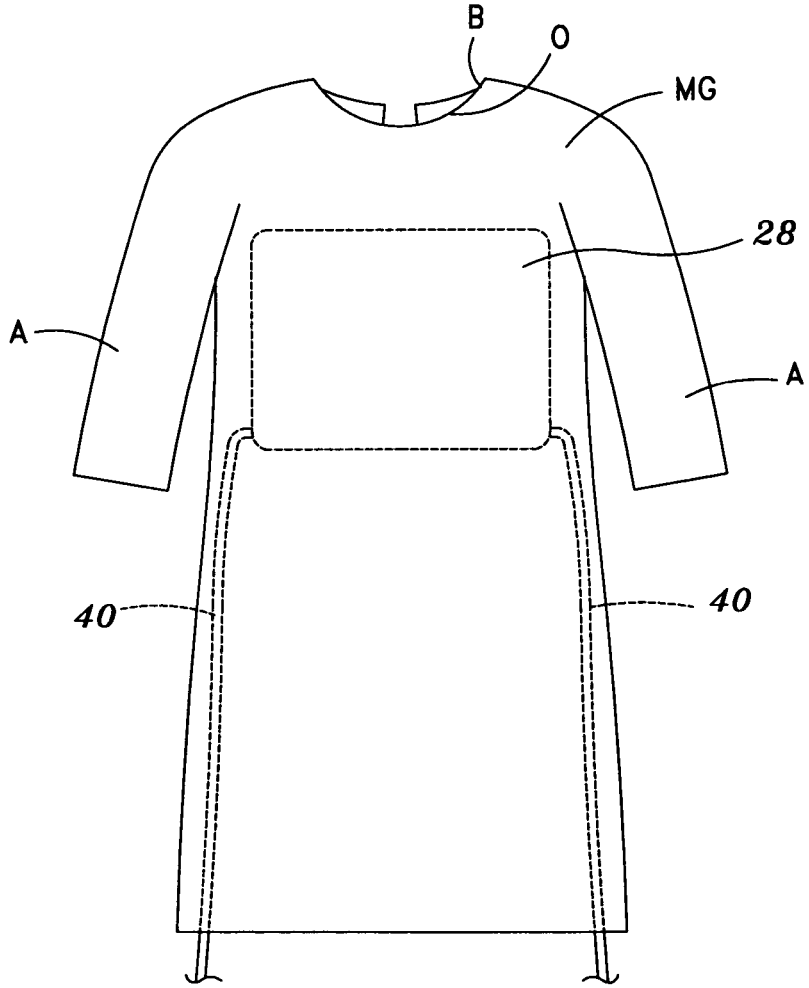
Fig. 2

MEDICAL GARMENT VENTILATION SYSTEM

FIELD OF THE INVENTION

The present invention relates to garments worn by medical personnel and, more particularly, to a system and method for venting such a garment.

BACKGROUND OF THE INVENTION

Medical personnel are generally required to wear special garments. In the operating room, for example, such personnel generally wear operating room gowns. These garments generally cover substantially all of the wearer's body except for the hands, feet and head.

The purpose of these garments is two fold, both to provide a barrier for protection of the patient and a barrier for protection of the medical personnel. One disadvantage to the medical garment is that it serves not only as a potential barrier to transmission of fluids, germs and the like, but also as a "thermal" heat barrier. Thus, these garments trap heat generated by the wearer.

In many cases, these garments may result in the wearer becoming undesirably hot. Some measures have been employed to counter-act this problem. For example, in the case of an operating room, medical personnel may be located near bright, heat generating lights. The medical personnel may quickly overheat, risking performance of the medical procedure. As a result, it is common practice to cool the operating room to a very low temperature. This, however, has associated problems or risks. First, it is expensive to maintain the operating room at a low temperature. More importantly, the patient, who must be at least partially uncovered for the procedure, is subjected to the low temperatures. At low temperatures, the patient's heart rate slows and blood pressure decreases. In the case of surgery, such body conditions are generally undesirable.

Some attempts have been made to address these issues, but all have a variety of problems and disadvantages. For example, U.S. Pat. No. 6,349,412 to Dean discloses a medical cooling vest. This vest holds a liquid coolant. Problems with this vest configuration include that the medical personnel must still wear their medical garments over the vest, such that the vest adds an entire additional layer of bulk. This reduces mobility of the wearer and adds another layer of insulating material to the wearer which counteracts the effects of the vest.

SUMMARY OF THE INVENTION

The invention is a system for ventilating a medical garment and associated wearer thereof, and a method of using the system. In one embodiment, the system comprises an air intake for association with the garment, an air flow path leading from the intake, and a means for drawing air into the intake and along the air flow path. The air intake is preferably located at an interior of the medical garment, between the garment and the wearer, so as to draw heated air from the area adjacent the wearer.

In one embodiment, the air intake comprises an intake body. The intake body defines a plurality of air intake ports, which inlet ports are in communication with at least one outlet port.

In a preferred embodiment, the intake body comprises an open cell material having a front face, an opposing rear face and at least one side. The front face defines the plurality of air intake ports, and the intake body is associated with a medical garment so that the ports face the wearer. In one embodiment, ports or openings are defined on both faces and the sides, and a covering layer isolates those ports on the rear and side(s) from those on the front face, and thus defines an exhaust space. One or more tubes defining the air flow path lead from the covering layer and the exhaust space, whereby air flows through the intake ports in the front face through passages in the body to the ports in the rear face and/or sides to the exhaust space, and then to the one or more tubes.

In one embodiment, the air flow path is defined by one or more tubes, conduits, hoses or other members which define a generally closed path from the intake body to the means for drawing air. In one embodiment, the air flow path is defined by a pair of tubes which extend from the intake body near a bottom thereof at opposing sides. The tubes extend outwardly and then downwardly along opposing sides of the medical garment when the system is associated with a garment.

In one embodiment, the tubes lead to a single hose, such as by connection at a "T" fitting. The hose leads to the means for drawing air or other inlet or coupling to such a means.

In a preferred embodiment, means are provided for controlling the rate of flow of air through the system. This means may comprise a means for controlling the means for drawing air (such as a pump speed control). In another embodiment, a valve is associated with each tube, each valve movable between a fully open position, a closed position and one or more partially open positions.

The means for drawing air may be an air pump. In one embodiment, the means for drawing air may be part of an existing medical facility air/fluid suction system. In that case, the hose defining the air flow path may be connected to an inlet of such a system.

In use, the air intake is connected to a garment. In a preferred embodiment, this comprises the step of locating the intake body at the interior or inner surface of the garment. Preferably, the intake body is positioned on the garment so that it is located over the wearer's upper torso, e.g. chest, such as by positioning it at the front of the garment between arm portions thereof and below a neck/head opening.

The tubes are routed along generally opposing sides of the garment to a lower opening thereof. The hose leading from the tubes is routed to the means for drawing air or other inlet leading to such a means.

The means for drawing air causes air to be drawn from the region between the garment and the wearer, at the wearer's chest. This air is drawn over the entire front face of the intake body, effectively evacuating heated air from that region, which air is replaced with cooler air from surrounding areas. The air flows through the intake body to the outlets and thereon through the air flow path, such as the tube(s) and hose, to the means for drawing air. The heated air is then preferably exhausted at a remote location.

The system is effective in cooling the wearer via the air exchange process. Because the system is so effective, the room temperature can be maintained at a much higher level.

The system does not interfere with the wearer's mobility, and thus performance of complex and tedious tasks such as surgery. The system can be disassociated from a medical garment, allowing the garment to be washed or replaced. The system can also be integrated for use with an existing suction system of a medical facility.

Further objects, features, and advantages of the present invention over the prior art will become apparent from the detailed description of the drawings which follows, when considered with the attached figures.

DESCRIPTION OF THE DRAWINGS

FIG. 1 schematically illustrates one embodiment of a system of the invention;

FIG. 2 illustrates an intake body portion of the system illustrated in FIG. 1 associated with a medical garment;

DETAILED DESCRIPTION OF THE INVENTION

Figure 3:
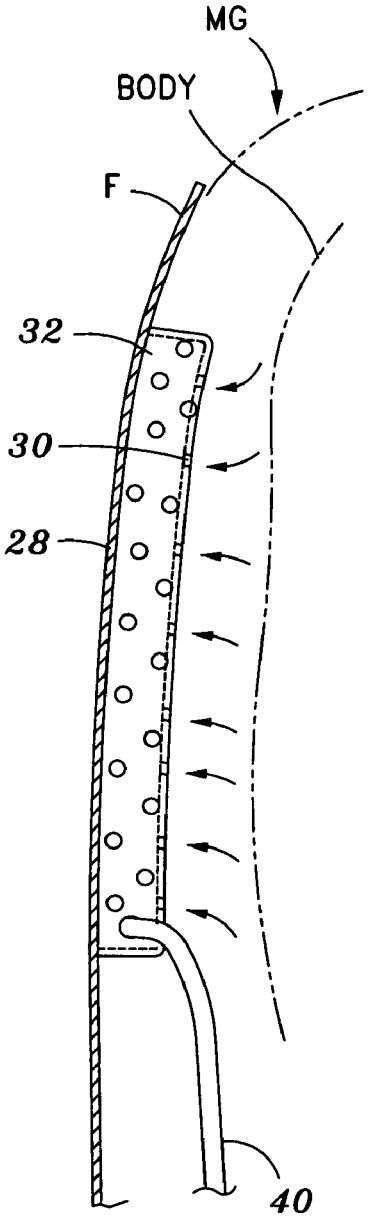
FIG. 3 is a cross-sectional view of a portion of the medical garment illustrated in FIG. 2.
Figure 4:
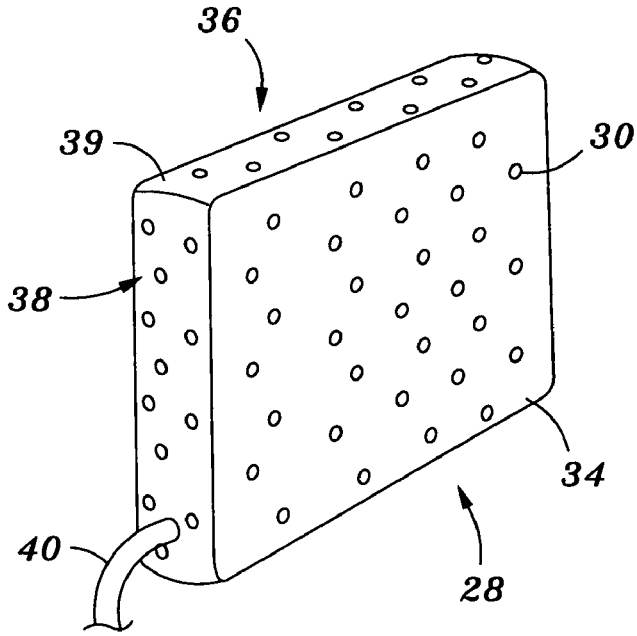
FIG. 4 illustrates in greater detail an intake body of the system in accordance with one embodiment of the invention.

The invention is system and method for venting a medical garment, and thus cooling the wearer of the garment. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a system and method for venting a medical garment such as a surgical gown. In a preferred embodiment, the system includes an air intake which is associated with a medical garment and through which air adjacent the wearer of the garment is withdrawn. The system preferably also includes at least one air suction device and at least one conduit or path from the suction device to the at least one air intake.

FIG. 1 illustrates one embodiment of a system 20 of the invention. In a preferred embodiment, the system 20 comprises an air intake 22, a means for drawing air 24, and at least one air flow path 26 leading from the air intake 22 to the means for drawing air 24.

Preferably, the air intake 22 comprises an intake body 28 which defines one or more locations at which air may be drawn. In a preferred embodiment, the intake body 28 defines multiple ports 30 or openings through which air may be drawn. The intake body 28 is configured to be associated with a garment, whereby air may be drawn from the vicinity of the garment.

The intake body 28 may have a variety of configurations. In one embodiment, the intake body 28 comprises an open cell material having an outer surface 32. The intake body 28 may have a variety of shapes and sizes. As described below, in one embodiment of use, the intake body 28 is configured to be located at the interior of a garment between the garment and a wearer of the garment. In such a configuration, it is desirable for the intake body 28 to be generally planar or thin, such as no more than about 1-2 inches in thickness, and more preferably no more than about 0.25-0.50 inches in thickness, or less. As also described below, in a preferred embodiment, the intake body 28 is configured to be positioned adjacent the upper torso or chest of the wearer, where it is advantageously positioned to removed heated air, including air rising by convection along the wearer's body. In such a configuration, the intake body 28 may be about 6-15 inches wide and 3-12 inches in height, and be generally rectangular in shape. So long as the intake body 28 serves the desired functions as detailed herein, the intake body 28 may have a variety of other shapes, however, such as oval, circular, square or irregular, and may be of a variety of other sizes.

The intake body 28 may be constructed of a variety of materials. For example, the intake body 28 may be an expanded polyurethane polyether. Such a material has an open cell structure which allows air to flow therethrough. In a preferred embodiment, the open cell configuration of the intake body 28 defines the at least one, and preferably a plurality, of ports or openings 30 in the outer surface 32. As described below, when the intake body 28 is located between a garment and a wearer, in one embodiment, the ports or openings 30 are located in a front surface which faces the wearer. Preferably, the intake body 28 defines a great number of ports 30 which are spaced over at least the front surface, whereby air is drawn over the entire face, and thus adjacent area or region.

Figure 5:
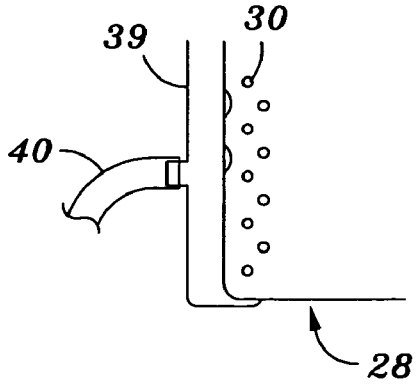
FIG. 5 is a partial cross-sectional view of a portion of the intake body illustrated in FIG. 4.

FIG. 5 illustrates one preferred embodiment of an intake body 28. As illustrated, the ports or openings 30 are exposed only in a front face 34 of the body 28, whereby all air flow is through ports 30 which are located closest to the wearer (rather than on an opposing rear face 36 or garment side of the intake body 28). In such a configuration, a barrier layer 39 may be located over the opposing rear face 36 of the intake body 28 (which faces the garment), and the one or more sides 38 between the front and rear faces 34,36, for blocking any ports or openings 30 which may be located in other than the front face 34. Such a layer may comprise a sheet or layer of plastic or the like which is located over the outside surface of the intake body 28.

The means for drawing air 24 is configured to generate a low or negative pressure at the air intake, whereby air is drawn into the intake. The means for drawing air 24 may be a variety of devices such as an air pump of a reciprocating piston variety, impeller or other type. Such devices are well known to those of skill in the art. In general, such devices 24 have an intake I into which air is drawn and an exhaust E through which air is expelled or released.

The air flow path 26 may comprise one or more elements and is preferably configured to define a generally closed path for the flow of air from the air intake 22 to the means for drawing air 24. In one embodiment, the air flow path 26 may be defined partially or entirely by one or more conduits, pipes, tubes, hoses or the like.

In a preferred embodiment, the system 20 of the invention is utilized to ventilate a medical garment and associated wearer. FIG. 2 illustrates one embodiment of a medical garment MG. As illustrated, the garment comprises a surgical gown. The system of the invention is configured for use with a variety of garments, however, and the garment could thus be of a variety of other types and styles. For example, instead of being a gown, the garment could be a pull-over type top.

The air intake 22 of the system is configured to be associated with the garment MG, whereby air is drawn from the vicinity of the garment, and thus the wearer, in a manner described in more detail below. In a preferred embodiment, the intake body 28 which comprises the air intake 22 is connected to the garment MG.

In a preferred embodiment, the intake body 28 is associated with the garment MG in a location corresponding to the upper torso or "chest" area of the wearer. In the embodiment illustrated in FIG. 2, the intake body 28 is generally rectangular in shape and is associated with a front body portion B of the garment MG between arm portions A thereof, below a head/neck opening O and between sides or side portions thereof. In this manner, when the garment MG is worn, the intake body 28 is located over the wearer's chest.

As illustrated in FIG. 3, in a preferred embodiment, the intake body 28 is located between the garment MG and the wearer. In an embodiment where the garment is defined by one or more layers of fabric F having an interior or inner surface and an exterior or outer surface, the intake body 28 is preferably located at the interior or inner surface.

The intake body 28 is preferably connected to the garment MG in order to maintain the position of the intake body 28 relative to the garment when the garment is worn. In one embodiment, the intake body 28 may be selectively attached to the garment MG, such as with hook and loop fastening material, snaps, one or more zippers, buckles or other means. In other embodiments, the intake body 28 may be generally permanently connected to the garment. For example, in one embodiment, the intake body 28 may be located between two layers of the garment, or may be sewn or stitched to the garment.

In the preferred configuration, air is drawn through the ports or openings 30 in the intake body 28. Preferably, this air is routed through the intake body 28, such as through various pathways 31 (see FIG. 1) or openings defined by the open-cell or other structure of the intake body 28, to one or more exit points. From those points, the air is preferably routed through the air flow pathway(s) 26.

In one embodiment, as illustrated in FIGS. 1-3, the air flow pathway 26 is at least partially defined by one or more tubes 40. Each tube 40 has a first end in communication with the intake body 28, such as by being coupled thereto. Preferably, each tube 40 is coupled to an outlet port of the intake body 28, which port is in communication with one or more of the inlet ports 30 via the passages or openings 31 through the intake body 28. In one embodiment, the outlets are parts defined at the rear face 36 or the one or more sides 38 of the intake body 28 (such as one or more of the ports 30 at the sides, which when a covering layer 39 is used, such ports are not blocked).

Each tube 40 may be coupled to the intake body 28 in a variety of ways. The tube 40 and intake body 28 may be coupled using one or more couplings or fittings. The tube 40 might also be press-fit into engagement or might be adhered to the intake body 28.

Figure 6:
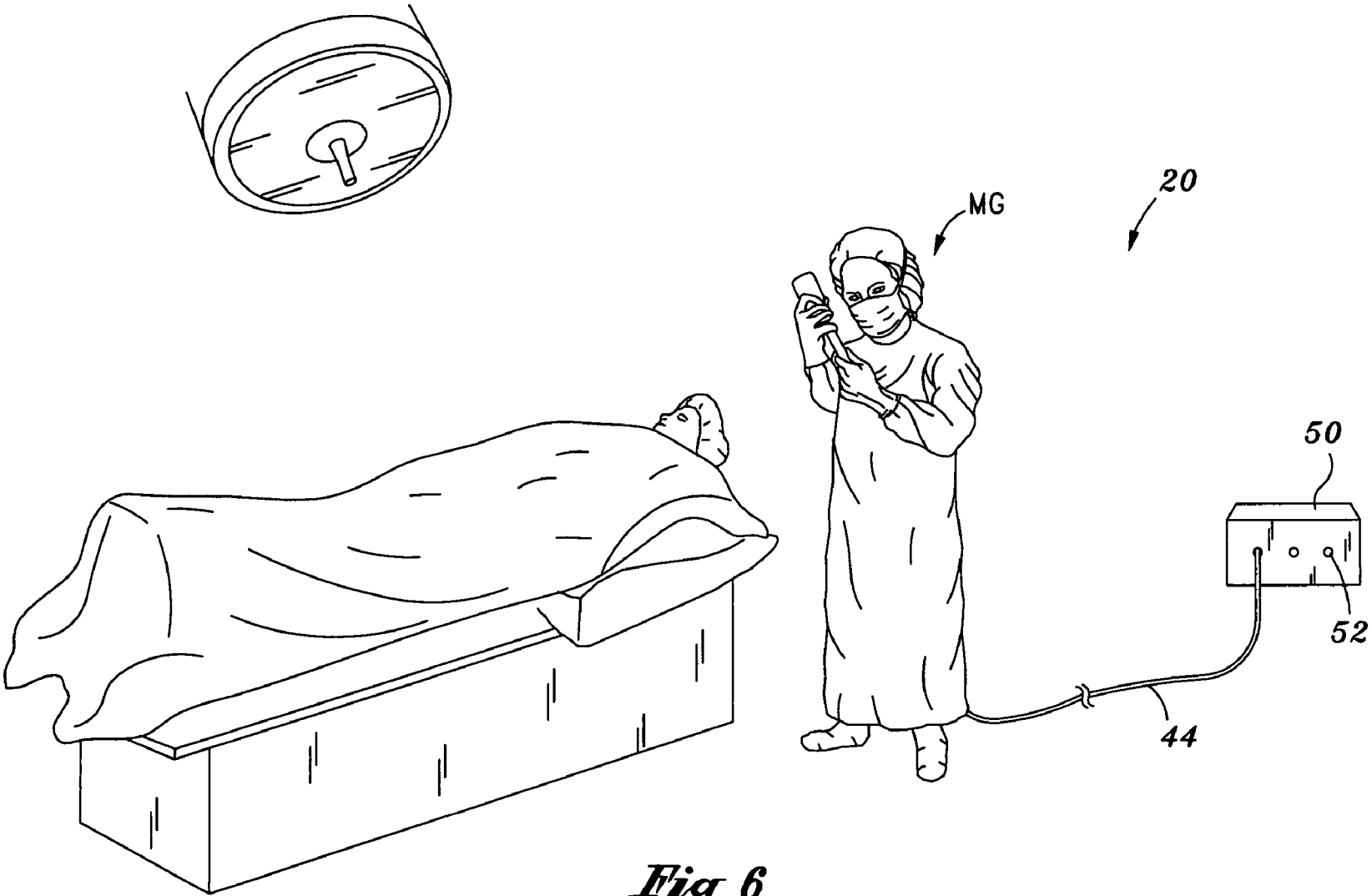
FIG. 6 illustrates one embodiment of a system of the invention as implemented in an operating room environment.

In another embodiment, as illustrated in FIGS. 5 and 6, the covering layer 39 described above may be sealed only in one or more areas thereof (such as along the edges thereof) to the intake body 28, and may otherwise define an air space between it and the intake body 28. In this configuration, each tube 40 may be connected to the covering layer 39 and be in communication with an air space between the layer 39 and the intake body 28. In this manner, air may be drawn through the inlet ports 30 in the front face 34 of the intake body 28 and exit any of the many ports 30 in the sides 38 and/or rear face 36 into the air space between the covering layer 39 and body 28, thus providing maximum air flow through the body 28.

It will be appreciated that instead of providing an intake body 28 with ports 30 on all surfaces, the body 28 may be particular configured so that intake ports 30 are defined on a front face, and those ports are connected via various passages to only one or more particular outlet ports, and the tubes may be connected to those outlet ports.

In one embodiment, as illustrated in FIG. 2, more than one tube 40 may be connected to the intake body 28 (or associated covering layer 39). For example, a tube 40 may be connected to opposing sides of the intake body 28. The number of tubes 40 which are connected to the intake body 28, including the location of their connection and their size, may vary, but are preferably selected based upon the desired air flow rate through the intake body 28. It is generally desirable, however, to limit the number of tubes 40 in order to minimize the "bulk" of the portion of the system associated with the garment.

In a preferred embodiment, a tube 40 is configured to extend from near the bottom of the intake body 28 at opposing sides thereof. In this configuration, the tubes 40 extend the shortest distance from or along the intake body 28 towards an exit point at the bottom of the garment, as detailed below. In addition, use of two tubes 40 allows the air flow rate to be changed and, when both tubes 40 are open, allows air to be drawn generally symmetrically through the intake body 28, and the generally equally distributed across the intake body 28.

Means may be provided for selectively controlling the rate of air flow through the intake body 28. In one embodiment, the rate of air draw or flow may be determined by the speed of the impeller, pump or other means for drawing air. In another embodiment, as illustrated in FIG. 1, the system 20 may include one or more flow control valves 42. Where the air flow path 26 is a single path, such as a single tube or conduit, a flow control valve 42 may be used to control the entire rate of flow between the air intake 22 and the means for drawing air 24.

In the preferred embodiment illustrated, where there the air flow path 26 includes two tubes 40 which lead from the intake body 28, a flow control valve 42 may be associated with each of the tubes 40. In this manner the air flow rate through each tube 40 may be independently controlled.

The valves 42 or other means for controlling the flow rate may be of variety of configurations. For example, each valve 42 may be a twist-type valve which permits flow rate to be controlled from a fully open to a fully closed position along with one or more intermediate positions with intermediate flow rates. Other types of devices may include tube or line clamps, sliding valves and other devices.

In the embodiment illustrated, a main or first portion of the air flow path 26 is defined by a single hose, tube or conduit 44. Preferably, nearer the intake body 28, the two tubes 40 are connected to this single hose 44. As illustrated, a "T" type coupling may be utilized to connect the tubes 40 to the hose 44.

FIG. 6 illustrates one embodiment of an environment of use for the system of the invention, that environment comprising an operating room. An operating room is but one environment of use for the system 20 of the invention, and the system 20 may be used or adapted for use in a variety of other environments, including a variety of other medical environments. Additional environments of use include, but are not limited to, laboratories and clean room work facilities.

In such an environment, means for drawing air may already be provided. For example, the operating room may include a panel 50 providing one or more inlets to which tubes, hoses or other devices may be connected. The inlets 52 lead to one or more means for drawing air. In this configuration, medical personnel may attach or couple medical instruments, such as suction devices used during surgery, to draw air and/or liquid from a patient.

In this configuration, the air inlet 22 is associated with a medical garment worn by medical personnel. As described, this may comprise connection of the intake body 28 to the garment. The air flow path 26 is provided between the air inlet 22 and the panel inlet 52. In the preferred embodiment, this may comprise the hose 44 and the one or more tubes 40. In this configuration, a first end of the hose 44 may be connected to an inlet 52 of the panel 50. The hose 44 leads to the two tubes 40, which in turn lead to the intake body 28.

One aspect of the invention is a method of ventilating a medical garment. One embodiment of such a method will be described with reference to operation of the system 20 described above. In a method of use, the intake body 28 is preferably associated with the medical garment. As described, in a preferred embodiment, the intake body 28 is associated with a front portion of the garment at an interior or inner surface thereof, so that the intake body 28 is positioned between the garment and a wearer, preferably adjacent the chest of the wearer. In an embodiment where the intake body 28 defines ports or openings 30 in a face thereof, the intake body 28 is preferably oriented so that the ports or openings 30 face away from the garment and towards a wearer when the garment is worn.

The air flow hoses or tubes are preferably routed from the intake body 28 downwardly. For example, in the case of the embodiment illustrated in FIG. 2, the tubes 40 are preferably routed outwardly from the opposing sides of the intake body 28 towards opposing sides of the garment, and then downwardly. In the case of a surgical gown, the tubes 40 preferably exit the bottom of the gown near the feet/ankles of the wearer.

The air flow hoses or tubes are placed in communication with the means for drawing air. In the embodiment system 20 illustrated in FIG. 1, a second end of the hose 44 which leads from the tubes 40, is preferably placed in communication with an air intake inlet. The inlet may be the inlet of a means for drawing air, or may be an associated port, such as the port 52 on the panel 50 as illustrated in FIG. 6. In such an embodiment, this step of connecting the hose 44 to the inlet 52 may require connection of appropriate couplings.

Once connected, if the means for drawing air is not already in operation, it is preferably placed in operation. In addition, the one or more valves which are located along the air flow path 26 may be adjusted in order to control the air flow.

At this time, air is drawn from the region surrounding the intake body 28, as best illustrated in FIG. 3. This air, which is located proximate the wearers chest, is drawn from the space adjacent the wearer's chest, into the ports 30 of the intake body 32. This causes cooler air to be drawn towards that same area, which air is then heated by the wearer and drawn away. In this manner, the user is cooled.

The heated or warm air is drawn into the intake body 28. The air is routed through the body 28 to the one or more outlets which are in communication with the air flow path between the intake body 28 and means for drawing air. Where the air flow path comprises tubes 40 leading from the intake body 28, the air is drawn to those tubes (as will be appreciated, air will only be drawn to those tubes which define an air flow path back to the means for drawing air—such that air is not drawn to those tubes where the associated valve is closed).

The air is then drawn through the tube(s) 40 and remaining air flow path 26, such as the hose 44, to the means for drawing air. From that point, the air is preferably exhausted. Preferably, the air is exhaust to a point remote from the wearer or the room where the wearer is located so that the heated air does not contribute to a reheating of the wearer.

The system and method of the invention have numerous advantages. The system is configured to draw heated air from the area which is proximate the medical personnel, thus effectively cooling the wearer. The effectiveness of the system is heightened because the air is drawn from the chest area of the wearer, an area of high heat generation. The system not only draws heated air from the source of heat generation, but is effective in drawing heated air which moves upwardly by convection along the wearer's body.

Another advantage of the invention is that it is relatively light and small, and can be associated with a variety of medical garments. Ventilated suits and vests are known. These suits, however, are very cumbersome and heavy and can significantly interfere with the wearer's ability to perform tasks. This is a particular concern relative to medical tasks such as surgery.

The system is also configured to be used with existing medical garments. This avoids the wearer having to wear both a medical garment and a separate cooling suit or the like, which actually contributes to the discomfort of the user, both considering mobility and because the extra suit contributes to further insulation and heat trapping.

Further, the intake body can be removed from the garment, permitting the garment to be cleaned or disposed of, while the intake body can be re-used, such as by re-attachment to the garment once cleaned or to a different garment.

Another advantage of the system is that because the air intake is located only at the front or chest portion of the wearer, the system does not interfere with the mobility of the wearer as might occur with a suit or the like which is associated with the arms and other movable portions of the wearer's body.

One advantage of the invention is that air is drawn away from the user. Forced air cooling systems may spread germs or the like from the medical personnel to the patient. The present invention has the advantage that germs and the like are actually drawn away from the wearer to a point remote from the patient.

The system also has the advantage that it can be integrated with existing hospital or medical facility suction systems. In this manner, only the intake body and air flow path portions of the system may be required to complete the ventilation system relative to facilities with such existing suction systems.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A system for ventilating a medical garment comprising:

a generally planar intake body for association with a medical garment, said body defining an intake face and including a plurality of intake ports spaced over said intake face, said intake body defining at least one outlet, said at least one outlet and one or more of said plurality of intake ports connected to one another by one or more passages through said body;

at least one generally closed air flow path, said path having a first end in communication with at least one of said at least one outlets of said intake body; and means for drawing air through said intake ports, through said intake body to said at least one closed air flow path, and along said at least one airflow path to an exhaust.

2. The system in accordance with claim 1 wherein said medical garment has an inner surface and an outer surface defined by one or more fabric layers, and said intake body is configured to be located at said inner surface of said garment.

3. The system in accordance with claim 1 wherein said medical garment is configured to extend over a torso of a wearer, said medical garment having a front portion configured to cover a chest portion of said wearer and a rear portion configured to cover a back portion of said wearer, and wherein said intake body is associated with said front portion of said garment.

4. The system in accordance with claim 1 wherein said intake body is constructed of an open cell material.

5. The system in accordance with claim 1 wherein said intake body has a rear face generally opposite said intake face and a side positioned between said intake face and rear face, and wherein said at least one outlet is defined in said side of said intake body.

6. The system in accordance with claim 5 wherein said airflow path is defined by at least one tube, each tube having a first end connected to said side of said intake body.

7. The system in accordance with claim 6 wherein a first tube extends from a first side of said intake body and second tube extends from a generally opposing second side of said body.

8. The system in accordance with claim 1 including means for selectively controlling the flow rate of air through said at least one air flow path.

9. The system in accordance with claim 7 including at least one valve positioned along each of said tubes, said valves configured to selectively control the rate of air flow through said tubes.

10. The system in accordance with claim 1 wherein said means for drawing air is a portion of an existing suction system having a plurality of intake ports and wherein said at least one air flow path includes a hose having an end configured to be attached to one of said intake ports.

11. The system in accordance with claim 10 wherein said plurality of intake ports are associated with a panel of an operating room.

12. The system in accordance with claim 1 wherein said medical garment comprises a surgical gown having a top and a bottom and a front and a back, wherein said intake body is configured to be located at said front of said gown at an inside thereof so as to be positioned between said gown and a wearer when said gown is worn.

13. The system in accordance with claim 12 wherein said intake body has first and second opposing sides and said air flow path comprises a first tube extending outwardly from said first side of said intake body and a second tube extending outwardly from said second side of said intake body.

14. The system in accordance with claim 13 wherein said first and second tubes extend downwardly along generally opposing sides of said gown and exit said gown at said bottom thereof.

15. The system in accordance with claim 14 wherein said air flow path includes a hose connected to a second end of said first and second tubes, and including at least one valve associated with said first tube to control the rate of air flow therethrough and at least one second valve associated with said second tube to control the rate of air flow therethrough.

16. A method of ventilating a medical garment to control the temperature of a wearer of the garment comprising:

connecting an air intake body to an interior, front portion of a medical garment in an area corresponding to a user's chest when said medical garment is worn, said intake body having at least one surface defining a plurality of intake ports therein and at least one outlet, said at least one outlet and one or more of said plurality of intake ports connected to one another by one or more passages through said body, said intake body connecting to said medical garment so that at least one surface of said intake body having said intake ports therein faces inwardly from said medical garment towards a wearer thereof;

providing at least one member defining a generally closed air flow path, said at least one member having a first end in communication with at least one of said at least one outlets of said intake body; and connecting a second end of said at least member defining said air flow path in communication with a means for drawing air.

17. The method in accordance with claim 16 wherein said step of connecting said second end of said at least one member comprises coupling an end of a hose to an inlet defined at a panel, said inlet leading to said means for drawing air.

18. The method in accordance with claim 16 including the step of adjusting at least one valve provided along said air flow path to control a flow rate of air along said path.

* * * * *